US005727992A

United States Patent [19]

Blomqvist et al.

[11] Patent Number: 5,727,992

[45] Date of Patent: Mar. 17, 1998

[54] METHOD AND APPARATUS FOR SHARPENING THE SURFACE OF A GRINDSTONE FOR A PULP GRINDER

[75] Inventors: Seppo Blomqvist; Juhani Valli, both of Tampere, Finland

[73] Assignee: Valmet Paperikoneet Inc., Helsinki, Finland

[21] Appl. No.: 525,355

[22] Filed: Sep. 8, 1995

[30] Foreign Application Priority Data

Jul. 11, 1995 [FI] Finland ..... 953398

[51] Int. Cl.[6] ..... B24B 1/00

[52] U.S. Cl. ..... 451/56; 451/36; 451/444; 241/166

[58] Field of Search ..... 451/56, 36, 444, 451/75, 21, 8, 72, 443, 4; 241/28, 38, 41, 294, 443, 91, 444, 166; 125/11.01

[56] References Cited

U.S. PATENT DOCUMENTS

| | | | |
|---|---|---|---|
| 1,413,060 | 4/1922 | Roberts . | |
| 2,568,096 | 9/1951 | Stewart | 51/262 |
| 2,919,517 | 9/1960 | Hestad et al. | 451/90 |
| 3,167,893 | 2/1965 | Coiardini | 51/262 |
| 3,568,377 | 3/1971 | Blohm | 51/262 |
| 3,973,737 | 8/1976 | Thorsell et al. | 451/546 |
| 4,173,248 | 11/1979 | Roberts | 162/141 |
| 4,434,012 | 2/1984 | Eckert et al. | 451/75 |
| 5,113,621 | 5/1992 | Grimes | 51/5 |
| 5,114,082 | 5/1992 | Brundick | 241/294 |
| 5,168,671 | 12/1992 | Kataoka et al. | 451/444 |
| 5,412,910 | 5/1995 | Woodson et al. | 451/38 |
| 5,441,144 | 8/1995 | Cook et al. | 451/38 |
| 5,487,695 | 1/1996 | Shank | 451/90 |

FOREIGN PATENT DOCUMENTS

| | | |
|---|---|---|
| 0584578 | 3/1994 | European Pat. Off. . |
| 26854 | 10/1954 | Finland . |
| 88938 | 4/1993 | Finland . |
| 57-168862 | 4/1981 | Japan . |
| 57-168862 | 10/1982 | Japan . |
| 9302836 | 2/1993 | WIPO . |

OTHER PUBLICATIONS

Patent Abstracts of Japan, vol. 7, No. 12, M186, Publ. 1982–Oct. 18.

Patent Abstracts of Japan for JP 57–168862 of Oct. 18, 1982.

*Primary Examiner*—Robert A. Rose
*Assistant Examiner*—George Nguyen
*Attorney, Agent, or Firm*—Ladas & Parry

[57] ABSTRACT

A method and an apparatus for sharpening the surface of a grindstone for a pulp grinder. In the method a high-pressure water jet is obliquely projected on the surface of the grindstone for detaching bonding material between abrasive grains, without excessively wearing a medium between grinding segments.

The apparatus comprises a nozzle, arranged to spray water obliquely onto the surface of the grindstone and a high-pressure pump for feeding high-pressure water through the nozzle. The nozzle is arranged to be moved by transfer means in the axial direction of the grindstone while the grindstone is being rotated.

11 Claims, 3 Drawing Sheets

FIG. 6
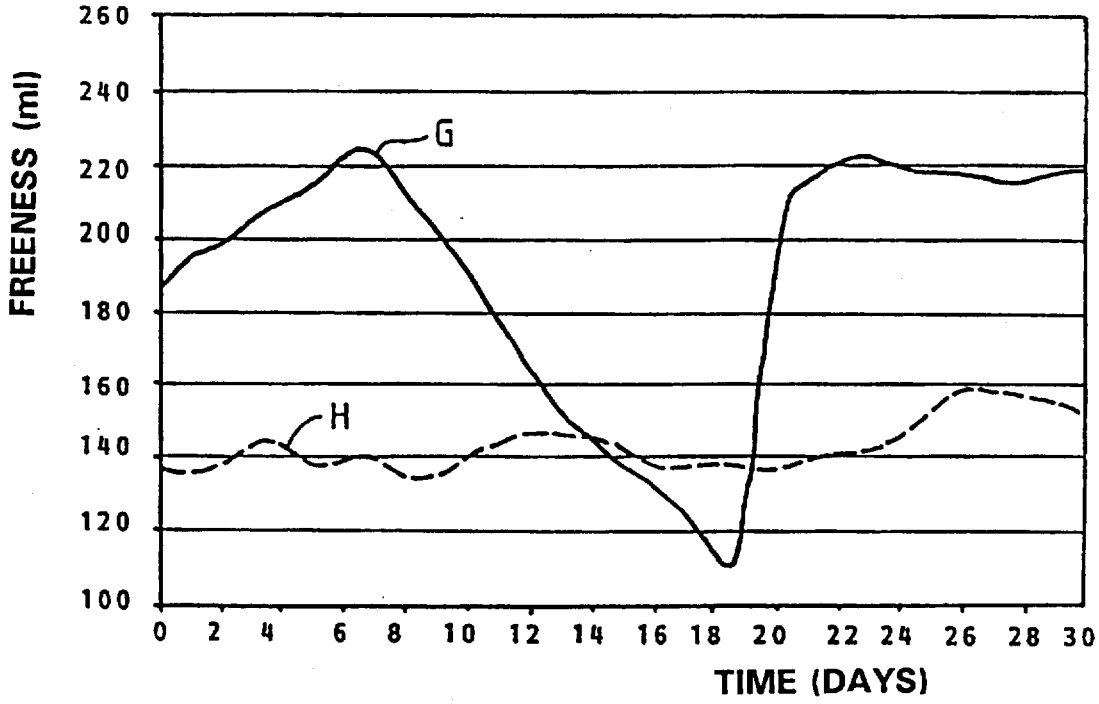
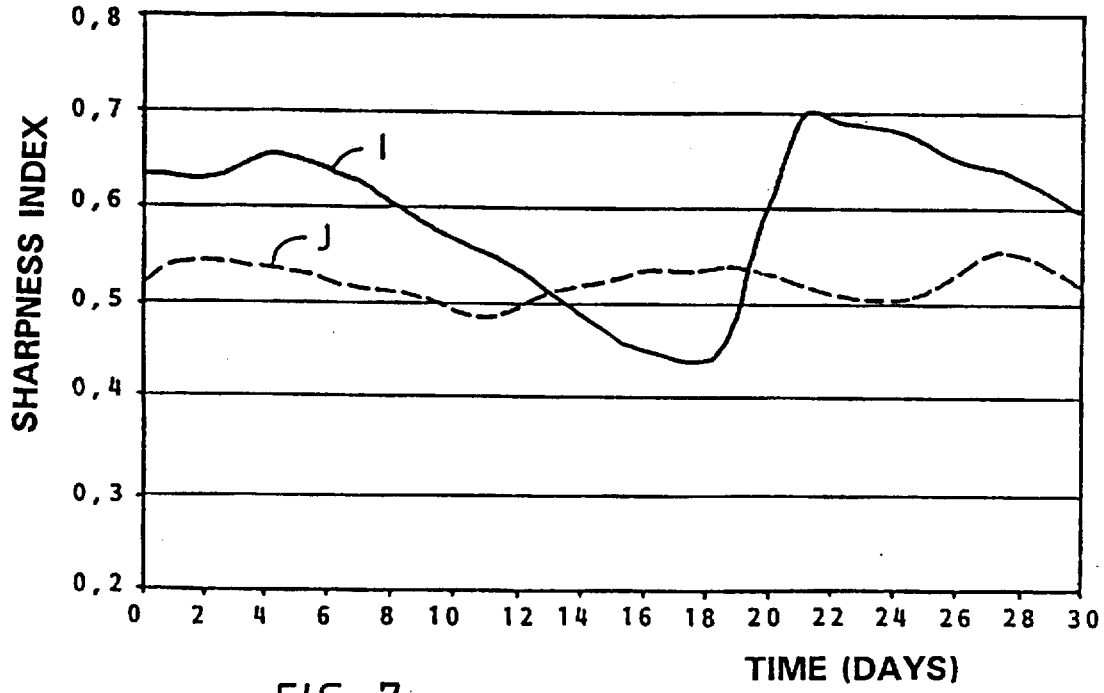
FIG. 7

METHOD AND APPARATUS FOR SHARPENING THE SURFACE OF A GRINDSTONE FOR A PULP GRINDER

It is an object of the invention to provide a method for sharpening the surface of a grindstone for a pulp grinder, the grindstone comprising grinding segments with medium in joints thereof, in which method at least one water jet is projected on the surface of the grindstone at a feed pressure high enough for the water jet to detach material from the surface of the grindstone, from one part of the surface of the grindstone at a time, whereat all of the surface of the grindstone is treated across its entire width with such a water jet by simultaneously rotating the grindstone.

It is a further object of the invention to provide an apparatus for sharpening the surface of a grindstone for a pulp grinder, the grindstone comprising grinding segments with medium in joints thereof, and the apparatus comprising at least one nozzle, arranged to be moved by transfer means in the axial direction of the grindstone during its sharpening so that the entire width of the grindstone is subjected to the water jet from the nozzle, and a high-pressure pump, arranged to pump a high-pressure water jet through the nozzle against the surface of the grindstone while the grindstone is simultaneously rotated during its sharpening.

In pulp grinders fibre is detached from wood by pressing wood material, such as blocks, chips, etc. against the surface of a grindstone rotating in its longitudinal direction, simultaneously spraying water thereon, whereby the combined effect of grinding by a grindstone and softening by water results in wood fibres becoming detached from the blocks, forming a pulp suspension with water. Although a grindstone is significantly harder than wood fibre, the surface of a grindstone stone wears slightly all the time during grinding. This changes the surface pattern and roughness of the grindstone resulting in changes in the grinding capacity and properties of the grindstone. Consequently the properties of the fibres formed and accordingly the properties of the pulp suspension change over a longer span of time whereby the usability of the pulp in manufacture of paper and the properties of the paper produced vary. To eliminate these drawbacks, the grindstone is conditioned by sharpening, which in this case means that material is removed from the surface of the grindstone to give it the desired quality.

Conventionally, this is carried out by passing a burr along the surface of a grindstone, the burr being pressed against the surface of the grindstone while the grindstone is being rotated. Consequently material becomes detached from one part of the surface of the grindstone, i.e. from the contact area of the burr and the grindstone, and thus by moving the burr in the axial direction of the grindstone as the grindstone rotates, material can be removed from all of the surface area of the grindstone. A blunted grindstone can be resharpened with a suitably shaped burr. Such a solution is known e.g. from Finnish Patent 26,584.

A drawback of known solutions is that during the sharpening stage the burrs not only remove mineral aggregate as they rotate, but also break abrasive grains, whereby the edges of the surfaces of the broken abrasive grains are extremely sharp and function almost like knives. Consequently after the sharpening, the pulp produced by the grindstone contains slivers and a large number of short broken fibres, which impairs the usability of the pulp produced immediately after the sharpening. Therefore burring is avoided and carried out at relatively long intervals. This again results in a significant variation of the so called freeness level, describing the variation in the properties of the mass, between sharpenings.

U.S. Pat. No. 1,413,060 discloses a method for sharpening a grindstone, wherein a grindstone is sharpened by projecting a perpendicular water jet on the surface of the grindstone. Said apparatus is intended for the sharpening of quite soft grindstones. At present, significantly harder synthetic grindstones than before are used, with grinding segments attached to the surface separated by a soft medium. The pressure of the water jet of the apparatus of the publication is too low for sharpening the grinding segments, and may thus not be applied to the sharpening of modern grindstones. Further, as the water jet of the apparatus is perpendicular to the grindstone, it excessively wears the soft medium between the grinding segments even at a low pressure. Excessive wear of the medium causes the segments to be detached. Further, as the apparatus is placed on top of the grindstone, it gathers mass and wood chips detached during grinding, thus blocking the grinding space and impairing the grinding result. The susceptibility of the apparatus to breakage is also evident as it is continuously exposed to detaching segments or parts thereof, and mass and wood chips.

The object of this invention is to provide a method and an apparatus for sharpening a grindstone easily and simply and preventing excessive wear of the medium between the grinding segments of the grindstone.

The method of the invention is characterized in that a water jet is projected on a grindstone, obliquely with respect to the surface of the grindstone and the joints of grinding segments, whereby the water jet detaches from the surface of the grindstone bonding material between abrasive grains.

The apparatus of the invention is characterized in that a nozzle is arranged to project a water jet on a grindstone, obliquely with respect to the surface of the grindstone and the joints of grinding segments.

It is an essential idea of the invention that the surface of a grindstone is sharpened by directing towards it, obliquely with respect to the surface of the grindstone and the joints of grinding segments, water jets affecting a small area at a pressure high enough to detach from the surface of the grindstone bonding material between abrasive grains, whereby the abrasive grains become better visible and after adequate removal of bonding material, the outermost and worn abrasive grains become detached, but the medium between the grinding segments is not excessively worn. An idea of another embodiment is that the nozzle producing the water jet is movable to and from the grindstone, and that the nozzle is positioned onto the grindstone only during sharpening.

The method and apparatus of the invention may be used for frequent sharpening of a grindstone by removing a small quantity of surface layer each time yet without breaking abrasive grains during sharpening or wearing excessively the medium between grinding segments. Consequently the freeness level of the pulp resulting from the sharpening changes less than in burring and sharpening may be carried out more frequently, whereby the total variation in the freeness level may be kept significantly narrower than with burring. As a result, the quantity and quality of pulp produced may be kept more even than usual.

The invention will be described in greater detail is the accompanying drawings where:

Figure 3:
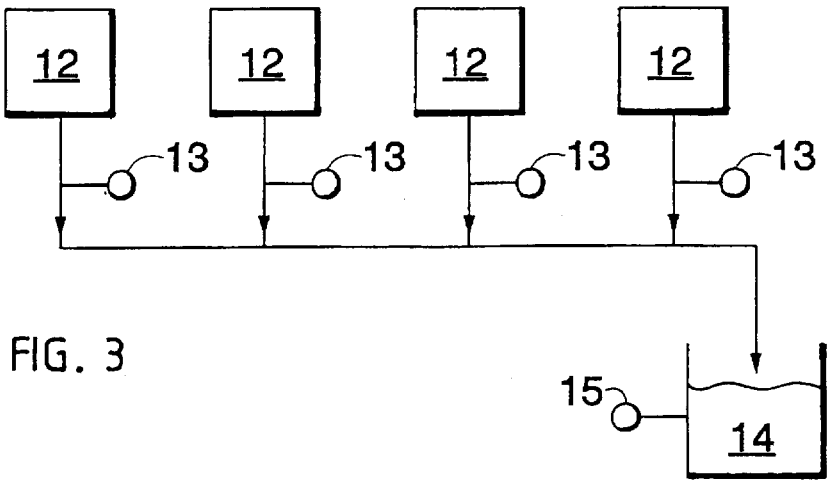
Figure 4:
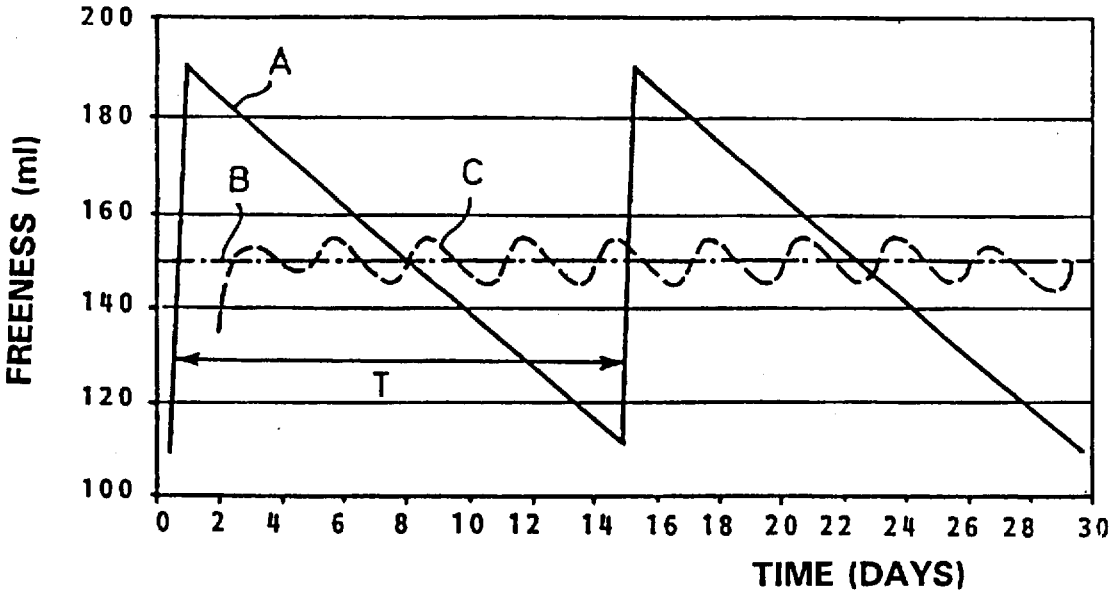
Figure 5:
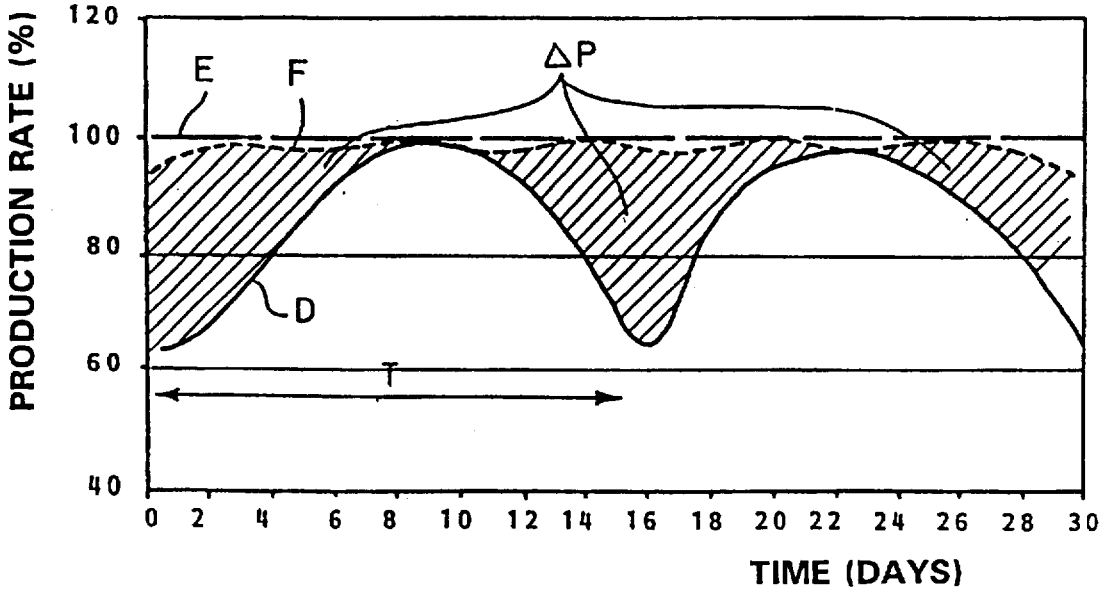

FIG. 3 schematically shows collection of control parameters of water jet sharpening, FIG. 4 schematically shows the effect of water jet sharpening and of burring on the freeness level of pulp, FIG. 5 schematically shows the effect of water jet sharpening on the production rate of a grinder, FIG. 6 shows the freeness level of pulp as a function of time in both burring and water jet sharpening as measured in connection with an empirical test, and FIG. 7 shows a sharpening index of a grindstone as a function of time in both burring and water jet sharpening as measured in connection with an empirical test.

Figure 1:
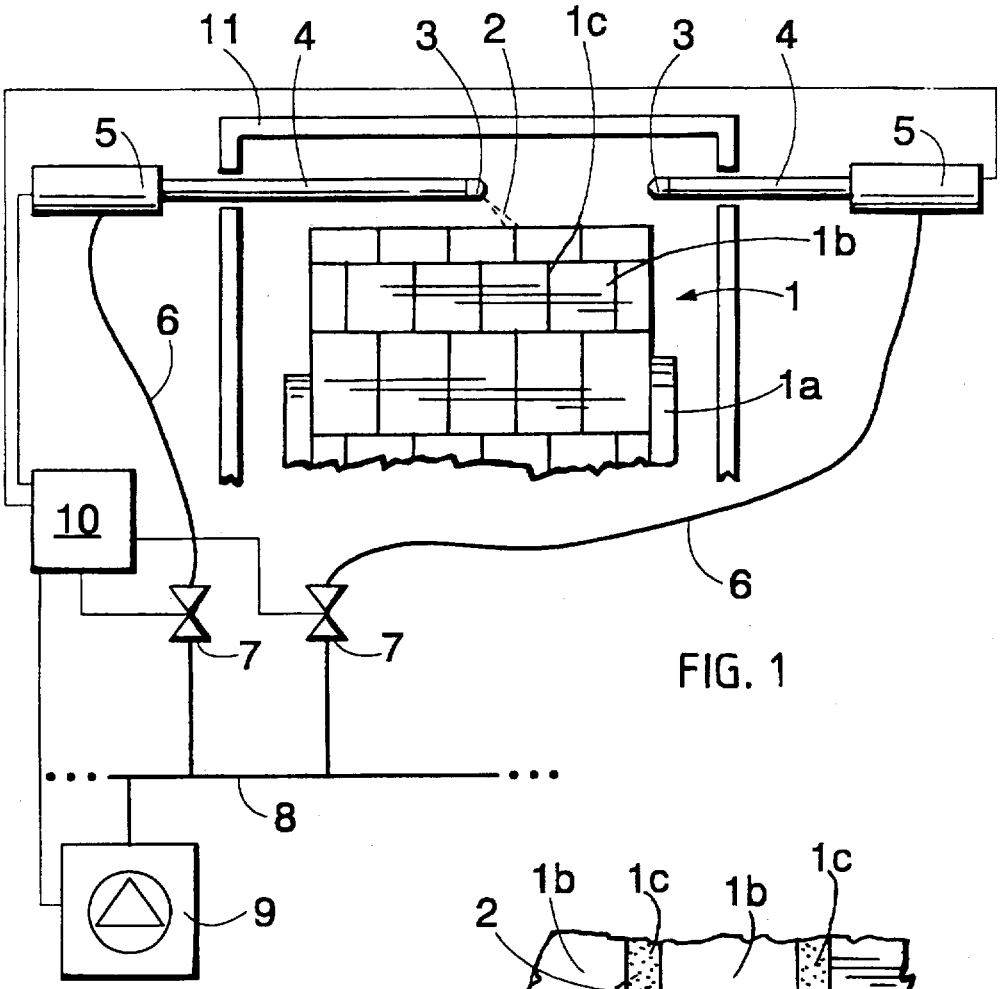
FIG. 1 is a schematic side view of sharpening by a water jet.

FIG. 1 shows grindstone 1 of a pulp grinder rotating about axle 1*a*. Typically a modern grindstone 1 has a specific grinding surface comprising grinding segments 1*b*, manufactured of ceramics or a ceramic mixture or the like, said surface grinding fibre off the wood. Joints 1*c* of grinding segments 1*b* contain a soft medium separating segments 1*b*. Grinding segments 1*b* may be e.g. quadrangular as shown in FIG. 1 or polygonal in a manner known per se. In the manner disclosed in the invention, a high-pressure water jet 2, from nozzle 3, is projected against the surface of grindstone 1. Water jet 2 is directed by nozzle 3 obliquely towards the surface of a grindstone, whereby the high pressure of the water jet detaches from the surface of grinding segments 1*b* bonding material between abrasive grains. However, as water jet 2 is in an oblique position, it does not excessively wear the medium in joints 1*c* of grinding segments 1*b*. Nozzle 3 is attached to arm 4, movable by transfer means 5 in the direction of axle 1*a* of grindstone 1 for the water jet to be able to be directed to all of the surface of grindstone 1 in a desired manner. A flexible tube 6 leads from transfer means 5 to valve 7. Valve 7 is connected by pipework 8 to high-pressure pump 9. High-pressure pump 9 serves to raise the pressure of the incoming water sufficiently high. The apparatus further comprises control means 10, arranged to control high-pressure pump 9, valves 7 and transfer means 5. By controlling valve 7, tube 6 is allowed to become pressurized only when the nozzle fed by said tube 6 is used. Each grinder may comprise one or two nozzles 3 and nozzle arms 4. Pressure is fed to pipework 8 by means of high-pressure pump 9, and several grinders may be attached to said pipework 8, provided control means 10 are used to control nozzle or nozzles 3, needed for sharpening grindstone 1, of only one grinder at a time. Frame 11 surrounds grindstone 1, and nozzle arms 4 are arranged to move through the side portions of said frame. By transfer means 5 nozzle arm 4 and nozzle 3 at its end may be pushed through the side portions of frame 11 for sharpening of grindstone 1. Transfer means 5 are used to remove nozzle arm 4 and nozzle 3 from frame 11 after the sharpening. Consequently nozzle arm 4 and nozzle 3 are not subjected to mass and wood chips detached during grinding and are not exposed to detaching grinding segments 1*b* or their parts. Transfer means 5 may be a feed screw, chain mechanism or some other motor or power transmission solution or any other solution known per se. Such solutions are completely known per se and are not described more closely herein.

Figure 2:
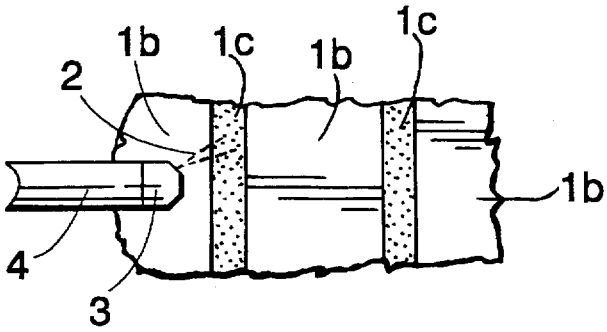
FIG. 2 is a top view of the head of a nozzle arm of the apparatus of FIG. 1.

FIG. 2 is a top view of the head of the nozzle arm of the apparatus of FIG. 1. The reference numbers of FIG. 2 correspond to the ones in FIG. 1. FIG. 2 shows that water jet 2 is obliquely directed also with respect to joints 1*c* of grinding segments 1*b*. The pressure used is between 500 and 2,500 bar, and it is essential that jet 2 is not perpendicular to joints 1*c*, nor parallel with them, for preventing excessive wearing of the medium in joints 1*c* of grinding segments 1*b*.

FIG. 3 schematically shows collection of control parameters of water jet sharpening. The sharpening power of the apparatus is adjusted by changing the pressure of water jet 2 and the number of travels of water jet 2 over grindstone 1. Both variables may be very accurately adjusted. Sharpening may be started when the freeness level of the pulp produced by the grinder is below a definable limit level. The freeness level may be measured either from a tank of each grinder 12 or from composite pulp 14 of a grindery. Numeral 13 refers to a freeness measurement made from a tank of a grinder, and numeral 15 to that made from the composite pulp of a grindery. The freeness levels obtained from the measuring points are lead to control means 10. With continuous freeness measurements, control means 10 may be arranged to automatically start sharpening when a defined minimum level is reached. On the other hand, control means 10 may be used to control the parameters of the sharpening apparatus, i.e. the pressure of water jet 2 and the number of travels of water jet 2 over grindstone 1, on the basis of the freeness level.

FIG. 4 schematically shows the variation in the freeness level of pulp produced by a grinder, in both burring and water jet sharpening. In FIG. 4, line A, which forms a serrated pattern, illustrates the change in the freeness level of pulp produced by burring as a function of time. Line B illustrates the theoretical desired or set freeness level and curve C illustrates the variation in the freeness level in water jet sharpening as a function of time. As illustrated by line A, the freeness level increases sharply in association with burring, and decreases thereafter relatively evenly as the grinding progresses until the grindstone again needs sharpening. Practically the sharpening interval is several days, typically about two weeks during which time the freeness level may vary e.g. ±30–40% of the mean level. This has a significant effect on the properties of the pulp produced and the range of variation is quite significant. In water jet sharpening illustrated by curve C sharpening may be carried out at shorter intervals, e.g. at intervals of two to three days. Since in burring extra material has in practice to be removed from the surface of a grindstone for ensuring the outcome of the sharpening, water jet sharpening, which removes essentially less material, may be repeated more frequently without decreasing the operating life of a grindstone. As illustrated by curve C, in water jet sharpening the roughness and sharpness of a grindstone remains such that the variation in the freeness level of pulp is e.g. about ±5%. Accordingly the properties of pulp remain as desired and consequently the properties of the paper manufactured from the pulp more uniform.

FIG. 5 schematically shows the effects of burring and water jet sharpening on output obtained by a grinder, curve D illustrating the output obtained by burring as compared with a theoretical maximum output, line E schematically illustrating a theoretical maximum output, and curve F illustrating the output obtained by water jet sharpening. The curves in FIG. 5 illustrate a situation Where the maximum output obtained by sharpening is set to correspond to a theoretical maximum output E. The output produced by the sharpness reached by burring, illustrated by curve D, is very wavy, and between line E and curve D remains a considerable area ΔP, representing the loss in output caused by the incapability of maintaining the production high owing to the properties of the surface of the grindstone. This is because the volume of production has to be adapted to the properties of the surface of a grindstone when keeping the freeness level of pulp within desired limits. Curve F illustrates output obtained by water jet sharpening as compared with the theoretical maximum output E. As is evident from curve F, the variation in output in water jet sharpening is very slight and only slightly wavy. Consequently, when water jet sharpening is used for a grinder, areas ΔP between curves D and F may also be utilized, said areas representing the increase in the volume of production obtained by using water jet sharpening and thus the advantages of water jet sharpening over burring. Measure T in the Figure, as in FIG. 4, illustrates a normal period of time between sharpenings.

FIG. 6 shows an empirical measuring result of the variation in the freeness of pulp when sharpening is performed with a burr and by a water jet. As is evident from FIG. 6, freeness in burring (curve G) varies between the levels 225 and 110 (ml) within one sharpening period. When water jet sharpening is used (curve H), freeness varies from about 135 to 155 (ml), the variation being less than ⅕ of that caused by burring.

FIG. 7 shows in a corresponding manner a calculated sharpness index of a grindstone, the value being known per se to one skilled in the art, in burring and in water jet sharpening. As is evident from FIG. 7, the sharpness of the surface of the grindstone varies between the levels 0.7 and 0.45 when burring is used (curve I), being at its highest after the sharpening and decreasing considerably toward the next sharpening. Consequently, immediately after the sharpening the edges of the abrasive grains of the grindstone are sharp and tend to cut the fibres instead of detaching them longer and more suitable for manufacture of paper. With water jet sharpening (curve J), the sharpness index varies between 0.48 and 0.55, whereby the cutting sharpness of the type occurring in burring is essentially absent and the grindstone may be used more effectively on the basis of the above information.

The specification and the drawings describe the invention only by way of example. The invention may be applied in different ways, e.g. by using one or more jet nozzles to achieve the desired sharpening rate and effect. It is characteristic that essentially all of the surface of the grindstone is sharpened in a similar manner to achieve an even sharpening result. Further, as it is typical that grooves are provided on the surface of a grindstone, essentially evenly spread across the area of the surface, for improving the grinding properties of a grindstone and for facilitating removal of pulp and water, a corresponding grooving may, if necessary, be provided on the surface of the grindstone by the sharpening apparatus of the invention. Likewise, use of different pump and nozzle constructions in a manner described in the invention is possible within the scope of the claims. Instead of mere water jet feed, it is naturally possible to feed different abrasive or otherwise suitable solid particles in the water jet to intensify the sharpening, but this is in no way necessary.

We claim:

1. In a method for sharpening a grinding surface of a grindstone for pulp grinder, the grindstone comprising segments composed of abrasive grains contained in a relatively soft bonding material and joints between the segments consisting of relatively soft bonding medium, the grindstone having a grinding surface formed by said segments and said joints, the method comprising projecting at least one water jet onto a portion of the grinding surface of the grindstone at a pressure high enough for the water jet to detach bonding material between abrasive grains of the segments of the grinding surface and causing the water jet to travel across an entire width of the surface of the grindstone while simultaneously rotating the grindstone, whereby to sharpen the entire grinding surface, the improvement wherein:

the projecting of the water jet is oblique to the surface of the grindstone and to said joints, whereby the water jet detaches from the surface of the grindstone bonding material between abrasive grains but only removes a minimum amount of said medium in the joints, said water jets being oblique to said joints in both a longitudinal and a circumferential direction of said joints.

2. The method according to claim 1, and further comprising moving a nozzle for the projecting of the water jet to the surface for the duration of the sharpening and removing the nozzle from the surface after the sharpening.

3. The method according to claim 2, wherein the moving of the nozzle comprises pushing the nozzle to the surface through a side portion of a frame of a pulp grinder.

4. A method according to claim 1 wherein a freeness level of pulp produced in sharpening is measured and the pressure of the water jet and the number of travels of the water jet over the grindstone are controlled on the basis of the measured freeness level.

5. The method according to claim 4 wherein the freeness level is essentially continuously measured.

6. In an apparatus and grindstone combination for sharpening a grinding surface of the grindstone for a pulp grinder, the surface having abrasive grains with bonding material therebetween in segments with medium in joints therebetween, and the apparatus having at least one nozzle means for projecting a water jet onto the surface, transfer and rotation means for moving the nozzle means in an axial direction of the grindstone while simultaneously rotating the grindstone so that the entire surface is subjected to the water jet and high-pressure pump means for projecting the water jet onto the surface at a pressure high enough to detach some of the bonding material from between the abrasive grains, whereby to sharpen the grindstone, the improvement wherein:

the nozzle means projects the water jet obliquely to the surface and the joints in both a longitudinal and a circumferential direction of said joints.

7. The apparatus and grindstone combination according to claim 6, wherein the transfer means is operative for moving the nozzle means relative to the grindstone for the duration of the sharpening and removing the nozzle means from the grindstone after the sharpening.

8. The apparatus and grindstone combination according to claim 6, and further comprising a pipework, a valve and a tube to connect the high-pressure pump means via the transfer means to the nozzle means, the valve being between the pipework and the tube so that the tube is pressurized only during the sharpening.

9. The apparatus and grindstone combination according to claim 6, and further comprising a second apparatus connected to be fed by the high-pressure pump means.

10. The apparatus and grindstone combination according to claim 9, and further comprising control means for using one apparatus at a time.

11. The apparatus and grindstone combination according to claim 6, and further comprising means for measuring a freeness level of pulp and control means for adjusting the pressure of the water jet and a number of travels of the water jet over the grindstone.

* * * * *